US009212456B2

(12) United States Patent
Pier et al.

(10) Patent No.: US 9,212,456 B2
(45) Date of Patent: Dec. 15, 2015

(54) AUTOMATIC RAIL FASTENER ORIENTER

(71) Applicant: NORDCO INC., Oak Creek, WI (US)

(72) Inventors: Michael Thomas Pier, Fox Point, WI (US); Daniel Edward Van Ert, Franklin, WI (US); Justin Jerome Pipol, Union Grove, WI (US); James William Boyd, New Berlin, WI (US)

(73) Assignee: Nordco Inc., Oak Creek, WI (US)

( * ) Notice: Subject to any disclaimer, the term of this patent is extended or adjusted under 35 U.S.C. 154(b) by 204 days.

(21) Appl. No.: 13/736,479

(22) Filed: Jan. 8, 2013

(65) Prior Publication Data

US 2014/0190365 A1 Jul. 10, 2014

(51) Int. Cl.

| | |
|---|---|
| ***B65G 47/14*** | (2006.01) |
| ***B65G 47/16*** | (2006.01) |
| ***B65G 47/22*** | (2006.01) |
| ***B65G 47/24*** | (2006.01) |
| ***E01B 29/24*** | (2006.01) |

(52) U.S. Cl.

CPC ..... *E01B 29/24* (2013.01)

(58) Field of Classification Search

None

See application file for complete search history.

(56) References Cited

U.S. PATENT DOCUMENTS

| | | | | |
|---|---|---|---|---|
| 1,615,137 | A | 1/1927 | Ruby | |
| 1,747,140 | A | 2/1930 | Smith | |
| 3,203,590 | A | 8/1965 | Maki | |
| 3,907,099 | A | 9/1975 | Smith | |
| 4,014,460 | A | 3/1977 | Bryan, Jr. | |
| 5,398,616 | A * | 3/1995 | Eidemanis et al. | 104/17.2 |
| 5,465,667 | A | 11/1995 | Hosking et al. | |
| 7,104,200 | B2 | 9/2006 | Hosking et al. | |
| 7,216,590 | B2 | 5/2007 | Eldridge et al. | |
| 8,516,965 | B2 * | 8/2013 | Pier et al. | 104/17.1 |
| 8,857,344 | B2 * | 10/2014 | Pier et al. | 104/17.1 |

* cited by examiner

*Primary Examiner* — Kavel Singh

(74) *Attorney, Agent, or Firm* — Greer, Burns & Crain, Ltd.

(57) ABSTRACT

A rail fastener orienter is provided for orienting rail fasteners to a desired orientation, the fasteners having a head, an opposite tip and a shank connecting the head to the tip, and being sequentially provided to the orienter in one of a head right, head left, head up and head down orientation. The orienter includes a frame having an upper end and an opposite lower end, and defining a track with an inlet adjacent the upper end, and an outlet adjacent the lower end, the track dimensioned for slidingly and rotatingly accommodating the shank. At least one stage holder is provided for accommodating the fastener in the track as the head is at least partially engaged by at least one bumper for repositioning to a desired one of the orientations, such that the fastener reaches the outlet in the desired orientation after axial rotation.

17 Claims, 7 Drawing Sheets

AUTOMATIC RAIL FASTENER ORIENTER

RELATED APPLICATION

The present application is related to commonly-assigned, copending U.S. patent application Ser. No. 13/737637, for Automatic Spike Feeder System.

BACKGROUND

The present invention relates generally to material handling equipment, and more specifically to equipment for orienting sorted items, such as rail fasteners including spikes, anchors, clips and other similar articles.

Currently, rail spikes used in a rail maintenance gang are stored in bulk and delivered in relatively small groups to an operator station by a reciprocating ram, as disclosed in commonly-assigned U.S. Pat. No. 7,216,590 which is incorporated by reference. In conventional rail maintenance operations employing the reciprocating ram, a designated operator draws individual spikes from the small group supplied by the ram, manually orients them in proper top-to-bottom and front-to-back position, and inserts them into a feed tray of a rail fastener driver magazine, of the type disclosed in commonly-assigned U.S. Pat. Nos. 5,398,616; 5,465,667 and 7,104,200, all of which are incorporated by reference. Manual loading of such feed trays is a tedious task, which also distracts the attention of the operator who is also controlling the spike driving operation. When two operators are provided, one to load the spike tray and one to control the spike driving mechanism, there is additional labor cost to the railroad for performing the spiking operation.

There is a continuing motivation by railroads to reduce the required labor of rail maintenance operations. Accordingly, maintenance machinery manufacturers have attempted to automate tasks where possible.

SUMMARY

The above-identified need is met by the present rail fastener orienter, in which fasteners are received in one of several orientations, and depending on the orientation, are manipulated for proper orientation in a fastener feeder magazine. In the preferred embodiment, the fasteners are rail spikes having a longitudinal axis and a head with a lip projecting from one side of an upper end of the spike. The present apparatus receives the fasteners in a consistent axially oriented orientation, with the heads at one end and the tip at the opposite end. Fasteners are fed to the present orienter apparatus in one of four positions, head up, head down, head right and head left. Regardless of the incoming spike orientation, the present apparatus is designed to orient the spikes so that the head is consistently oriented in a desired position for delivery to the fastener feeder magazine.

The orienter includes a housing defining a track in which the fastener is fed, and depending on the orientation of the head, is axially rotated using the dimensions of the track and the location of bumpers to result in a desired head orientation. As the fastener travels down the track to an outlet of the orienter, the fastener is placed in the desired orientation.

More specifically, a rail fastener orienter is provided for orienting rail fasteners to a desired orientation, the fasteners having a head and an opposite tip and a shank connecting the head to the tip, and being sequentially provided to the orienter in one of a head right, head left, head up and head down orientation. The orienter includes a frame having an upper end and an opposite lower end, and defining a track with an inlet adjacent the upper end, and an outlet adjacent the lower end, at least a portion of the track dimensioned for slidingly and rotatingly accommodating the shank. At least one stage holder is provided for accommodating the fastener in the track as the head is at least partially engaged by at least one bumper for repositioning to a desired one of the orientations, such that the fastener reaches the outlet in the desired orientation after axial rotation.

In another embodiment, a rail fastener orienter is provided for orienting rail fasteners to a desired orientation, the fasteners having a head and an opposite tip and a shank connecting the head to the tip. The orienter includes a frame having an upper end and an opposite lower end, and defining a track with an inlet adjacent the upper end, and an outlet adjacent the lower end. The track is dimensioned for slidingly and rotatingly accommodating the shank. A first stage holder is configured for pivoting relative to the frame and defines a fastener retaining groove in communication with the track. A first driver is provided for moving the first stage holder from a first position to a second position. A second stage holder is configured for pivoting relative to the frame and defines a second fastener retaining groove in communication with the track.

A second driver is provided for moving the second stage holder from a third position to a fourth position. An outside bumper is located on the frame in operational proximity to the track. A handoff area is in communication with the track and is located between the first stage holder and the second stage holder. An inside bumper is located on the handoff area in operational proximity to the track. A controller is provided for operating the first stage sequentially before the second stage such that a fastener in the track is received by the first stage holder in the fastener retaining groove, and encounters the outside bumper for reorienting the head; as the first stage holder is moved to the second position, the fastener is moved to the handoff area, whereafter the second stage holder receives the fastener in the second groove, and the second stage holder is moved from the third position to the fourth position, and out the outlet.

In still another embodiment, a method is provided for orienting rail fasteners having a shank with an offset head at one end, and a tip at an opposite end. The method includes providing the fasteners to an orienter in an orientation with the head at one end, feeding the fasteners sequentially to an orienter having a track dimensioned for slidingly and rotatably accommodating the fasteners, the fasteners having one of a head left, head right, head up and head down orientation. Next, passing the fasteners to a first stage holder moving between a first position and a second position, where the fastener head encounters an outside bumper when the head is in an undesirable position for rotating the shank so that the head is reoriented. Subsequently, the fastener is passed to a handoff area where the fastener is passed to a second stage holder moving from a third position to a fourth position. At least one inside bumper surface is provided for engaging and reorienting the head when in an undesirable position to a desirable position, and the oriented fastener is then fed from an outlet of the track to a rail fastener applicator.

DETAILED DESCRIPTION

Figure 2:
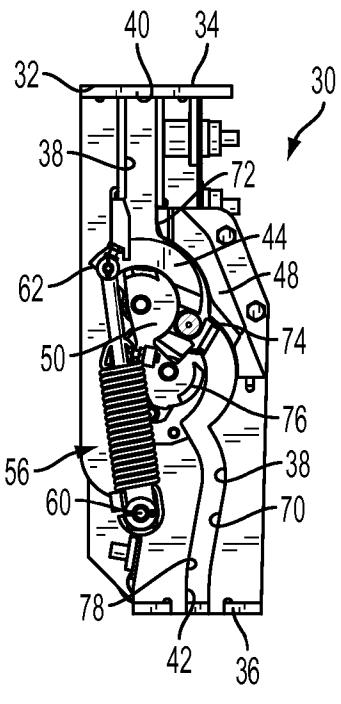
FIG. 2 is a front elevation of the present orienter.
Figure 1D:
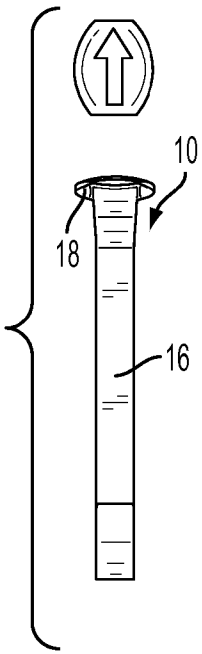
FIGS. 1*a-d* depict a conventional rail fastener in each of the four orientations delivered to the present orienter.
Figure 1C:
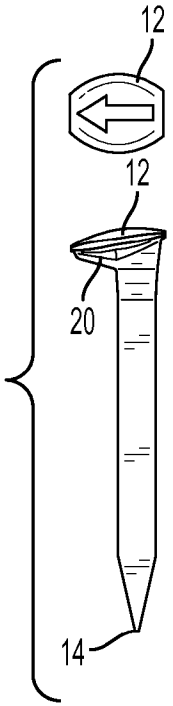
Figure 1B:
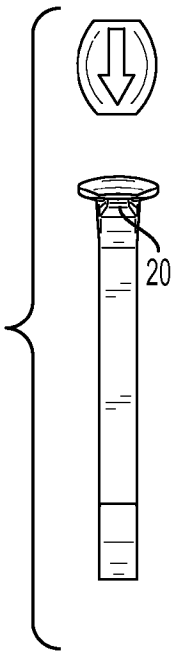
Figure 1A:
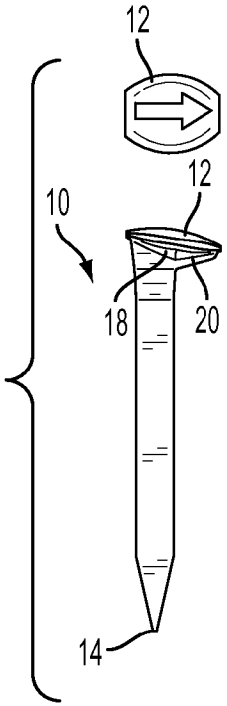

Referring to FIGS. 1*a-d*, a rail fastener, generally designated 10 is shown as a cut spike, however other fasteners are considered suitable for use with the present orienter, depending on the application. The fastener 10 has a head 12 and an opposite tip 14, with a shank 16 connecting the head to the tip. As is known in the art, the shank 16 is quadrilateral in transverse cross-section, and is preferably square. An underside 18 of the head 12 is provided with an angled tang 20 extending between the head and the shank 16. As seen in FIGS. 1*a-d*, the fastener 10 is sequentially depicted in each of a head right, head down, head left and head up position. These are the orientations of the fastener 10 as provided to the present orienter, generally designated 30 (FIG. 2), from an upstream rail fastener handling and sorting apparatus (not shown), an example of which is depicted in commonly-assigned U.S. patent application Ser. No. 13/053,523, incorporated by reference herein.

Referring now to FIGS. 2-7, the present orienter 30 includes a frame 32 preferably oriented at an inclined angle with an upper end 34 located above an opposite lower end 36, such that fasteners 10 encountering the frame pass by gravity from the upper end to the lower end. While the preferred frame 32 is made of a pair of spaced, parallel plates, other configurations are contemplated depending on the application. A track 38 is defined in the frame 32 and extends from an inlet 40 located adjacent the upper end 34 to an outlet 42 adjacent the lower end 36 and follows a generally non-linear path as the fastener is reoriented, as described below. In addition, it is preferred that the track 38 is dimensioned for accommodating sliding and, in some portions, axial rotation of the shank 16 as it travels from the inlet 40 to the outlet 42.

Fastener orientation is facilitated in the orienter 30 by at least one and preferably two stage holders 44, 46, respectfully referred to as a first stage holder and a second stage holder, which receive the fastener 10 by the shank 16 and control movement of the fastener along the track as the head 12 is reoriented as required by at least one bumper 48, 76 to a desired one of the above-identified orientations, such that the fastener reaches the outlet 42 in the desired orientation after axial rotation. A handoff area 50 represented by an inside bumper plate 51, is attached to the frame in a position between and partially overlapping the first and second stage holders 44, 46 for performing additional fastener orientation as needed, and as described below.

Each of the first and second stage holders 44, 46 rotates about a respective pivot pin 52, 54 projecting transversely to the frame 32 and to the track 38. The first stage holder 44 pivots between a first position and a second position, and the second stage holder pivots between a third position and a fourth position. The pivoting action of each of the holders 44, 46 is controlled by a corresponding first and second driver 56, 58. In the preferred embodiment, the drivers 56, 58 are fluid powered cylinders with a spring return, however other equivalent devices are contemplated, including but not limited to solenoids, double-acting cylinders, and the like. Each of the drivers 56, 58 is pivotally connected at a first end 60 to the frame 32 and at a second end 62 to the corresponding holder 44, 46 so that extension of the drivers will move the holders in the track 38 respectively from the first and third positions, to the second and fourth positions.

Figure 7:
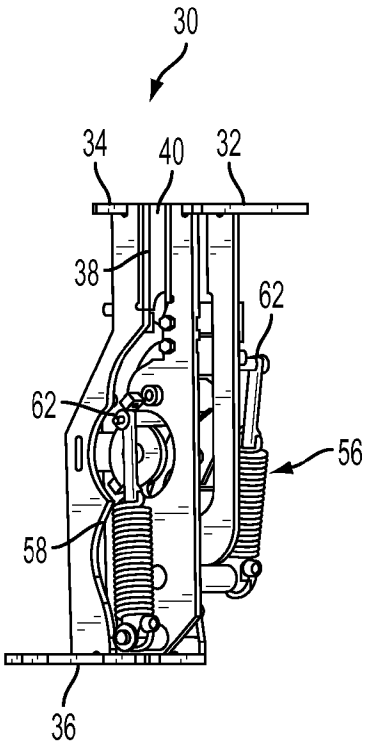
FIG. 7 is a bottom perspective elevation of the present orienter in a second position.
Figure 6:
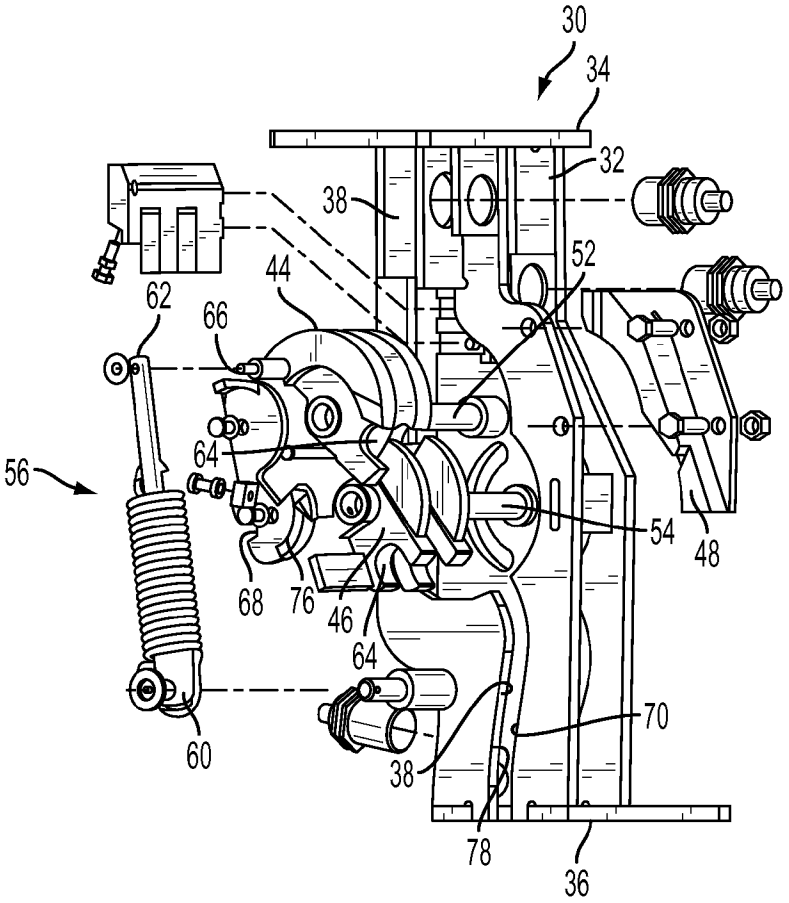
FIG. 6 is an exploded perspective view of the orienter of FIG. 5.
Figure 5:
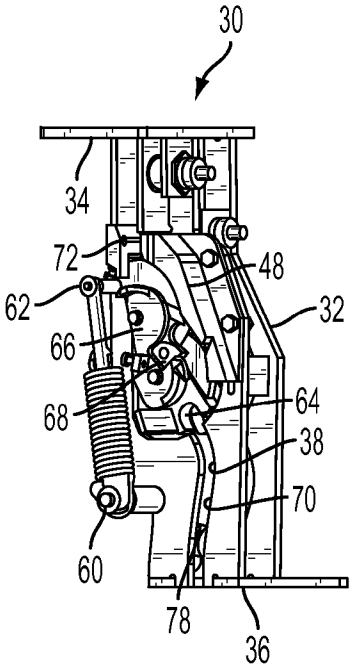
FIG. 5 is a top perspective elevation of the present orienter in a first position.

Referring now to FIGS. 5-7, each of the first and second stage holders 44, 46 is provided with a generally "U"-shaped groove 64 that rotatably accommodates the fastener 10 as it is moved along the track 38. Also, the inside bumper plate 51 defines a transfer recess 68 is mounted to the frame 32 so that the transfer recess between the first and second holders.

Referring now to FIGS. 2, 5 and 6, the present orienter 30 includes an outside bumper 48 located on the frame 32 in operational proximity to the track and associated with the first stage holder 44. Preferably, the outside bumper 48 is generally arcuate and abuts an outer edge 70 of the track 38. A ramped leading surface 72 of the bumper 48 is located near the inlet of the track 38. A second ramped surface 74 of the bumper 48 is located adjacent and on an opposite side of the track 38 from the transfer recess 68. Otherwise, the bumper 48 extends from a surface of the frame 32 a sufficient height to slidingly engage a peripheral edge of the fastener head 12.

Referring now to FIGS. 2 and 6, an inside bumper 76 is also generally arcuate in shape and is located on the inside bumper plate 51 in operational proximity to the track 38, preferably along an inner edge 78 and being operatively associated with the second stage holder 46. As explained in greater detail below, the inside bumper 76 is constructed and arranged for engaging the tang 20 of the fastener 10 for reorientation purposes as needed.

Figure 4:
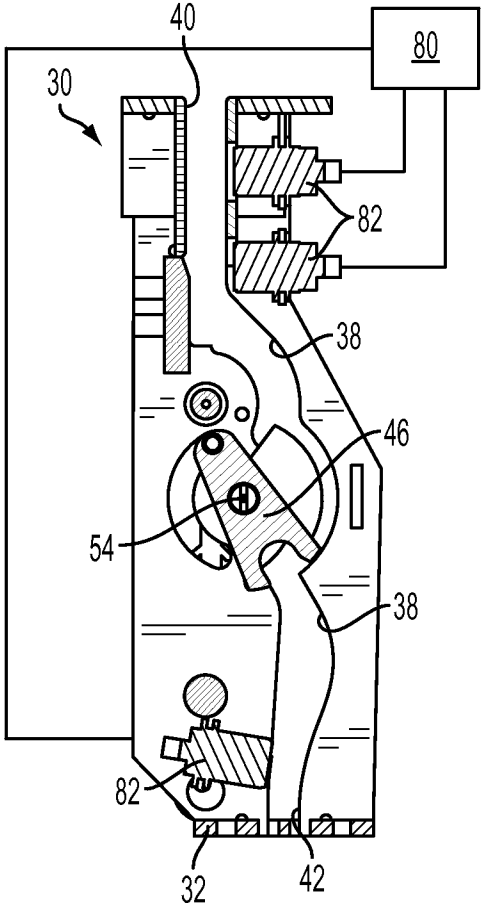
FIG. 4 is a cross-section taken along the line 4-4 of FIG. 3 and in the direction generally indicated.
Figure 3:
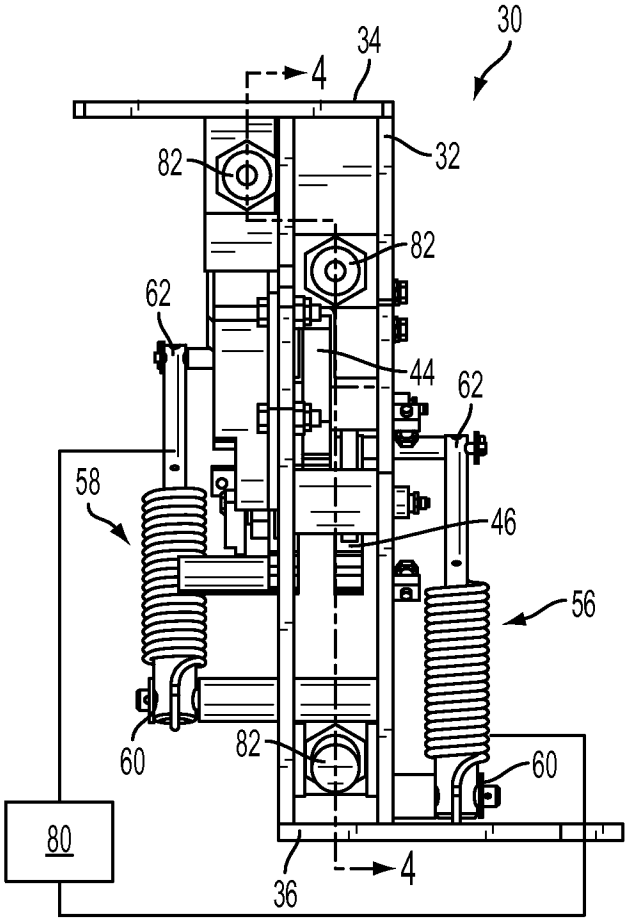
FIG. 3 is a side elevation of the present orienter.

Referring now to FIGS. 3 and 4, a controller, generally schematically indicated and designated 80, is provided to the orienter 30 and is a computer, programmable chip, CPU or the like as is well known in the art, and among other control functions, operates hydraulic valves (not shown) connected to the drivers 56, and 58 for selective operation as is known in the art. The controller 80 is configured for operating the first stage holder 44 sequentially before the second stage holder such that a fastener 10 in the track 38 is received by the first stage holder and encounters the bumper 48 for reorienting the head 12 as needed. Also, as the first stage holder 44 is moved to the second position, the fastener 10 is moved to the handoff area 50, whereafter the second stage holder 46 receives the fastener. The second stage holder 46 is then moved from the third position to the fourth position, and ultimately out the outlet 42. Also in FIG. 3, it should be noted that the first and second drivers 56, 58 are located on opposite sides of the frame 32.

At least one sensor 82, such as an opto or magnetic sensor or a proximity switch, as is well known in the art, is located in operational proximity to the track 38 for monitoring the action of the orienter 30 as well as upstream fastener handling equipment. In the preferred embodiment, the sensors 82, connected to the controller 80, monitor the number of fasteners 10 in the track 38 and also trigger the operation of the drivers 56, 58.

Referring now to FIG. 2, the second stage holder 46 optionally includes a fastener head support 84, which stabilizes the fastener head 12 during travel in a lower second of the track 38 while under the control of the second stage holder. It has been found that the support 84 engages a flat spot on the shank 16 near the underside 18 of the head 12 in a way that prevents unwanted movement of the fastener 10 in the track 38.

Figure 8A:
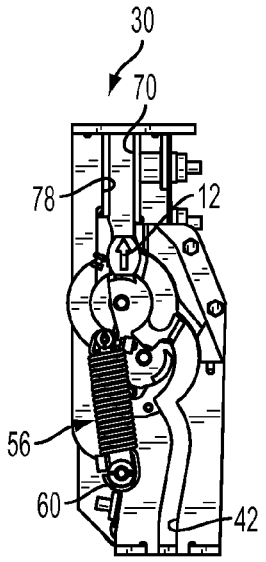
FIGS. 8*a-h* are sequential front elevational views of the present orienter positioning a head up fastener.
Figure 8B:
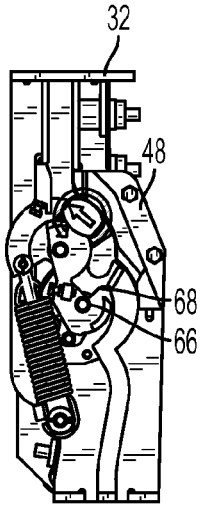

Referring now to FIGS. 8*a*-8*h*, operation of the present orienter 30 will be described when the fastener head 12 is in the up oriented position. In FIG. 8*a*, the fastener 10 is seen entering the track 38, and has nested in the groove 64 in the first stage holder 44, which is in the first position. In FIG. 8*b*, the first driver 56 begins to extend, moving the fastener 10 towards the handoff area 50. However, as the fastener 10 reaches the outside bumper 48, the head 12, and specifically the tang 20 is engaged by the bumper. Thus, the movement of the fastener 10 down the track 38 by the first driver 56 causes the head 12 to rotate counter-clockwise, so that the fastener head has rotated approximately 90 degrees compared to its initial position.

Figure 8C:
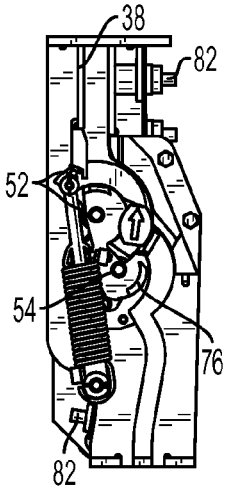
Figure 8D:
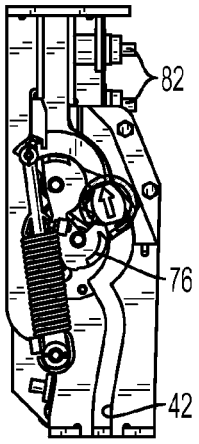

Next, in FIG. 8*c*, the first driver 56 is fully extended, the first stage holder 44 is in the second position, and the fastener 10 is inserted in the inside bumper plate 51, specifically in the transfer recess 68. In this same position, the fastener is accommodated in the groove 64 in the second stage holder 46. During this phase, the fastener 12 does not rotate relative to the track 38, but instead follows the track in the orientation resulting from the rotation described above in FIG. 8*b*. In FIG. 8*d*, the second driver 58 begins to extend, carrying the fastener 10 from the inside bumper plate 51. At this time, the fastener head 12 engages the second ramped surface 74 on the outside bumper 48, and the head 12, and of course the fastener 10 is again rotated counterclockwise to place the head in the heads up position.

Figure 8E:
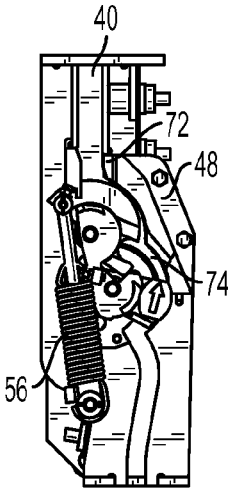
Figure 8F:
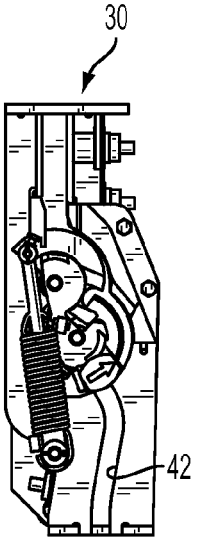
Figure 8G:
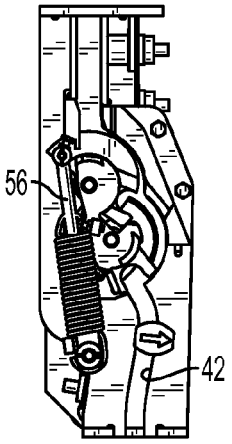
Figure 8H:
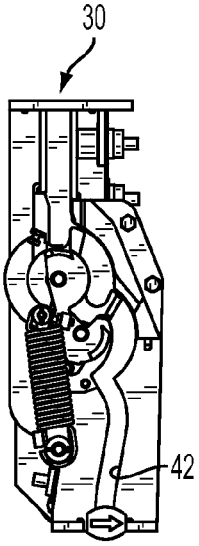

Referring now to FIG. 8*e*, the second driver 58 continues its extension, carrying the fastener 10 down the track 38. In FIG. 8*f*, at the limit of the extension of the second driver 58, due to the curvature of the track 38 at that point, the fastener 10 is now positioned to enter the track outlet 42 in the desired head right orientation, which it retains as the fastener 10 travels to the outlet, seen in FIGS. 8*g*-8*h*. It will be noted that the outlet portion 42 of the track 38 has a narrower dimension to permit sliding action of the fastener shank 16, but not axial rotation which might change the desired orientation.

Figure 9A:
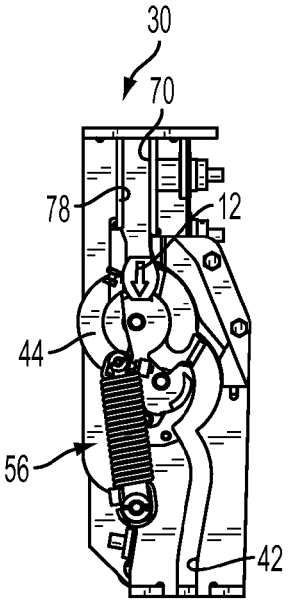
FIGS. 9*a-h* are sequential front elevational views of the present orienter positioning a head down fastener.
Figure 9B:
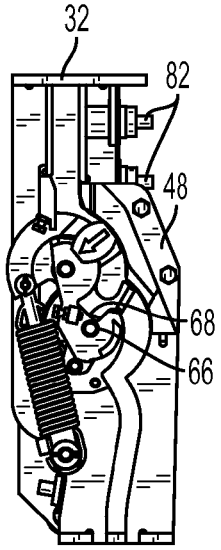
Figure 9C:
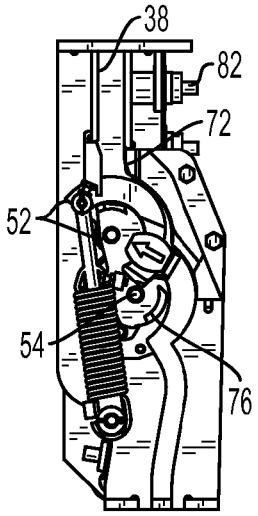
Figure 9D:
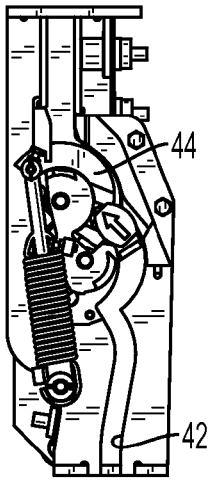
Figure 9E:
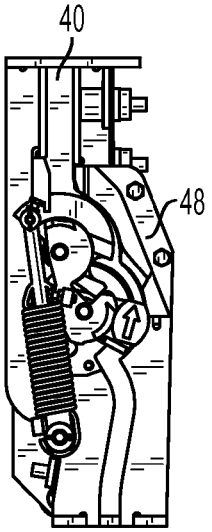

Referring now to FIGS. 9*a*-9*h*, operation of the present orienter 30 will be described when the fastener head 12 is in the down oriented position. In FIG. 9*a*, the fastener 10 enters the track 38, and is accommodated in the groove 64 of the first stage holder 44. In FIG. 9*b*, since the tang 20 faces the inner edge 74 of the track 38, it fails to engage the outside bumper 48. As such, the fastener retains its head orientation as the first driver 56 reaches full extension. In FIG. 9*c*, the fastener 10 reaches the inside bumper plate 51 and is engaged in the transfer recess 68. In FIG. 9*d*, as the second stage holder 46 carries the fastener 10 down the track, the fastener has a head up orientation, which it retains as the second driver 58 fully extends, and the head 12 also fails to engage the outside bumper 48 or the inside bumper 76, since the tang 20 is facing up, as seen in FIG. 9*d*. Referring now to FIG. 9*e*, as the second driver 58 extends, the head 12 retains its position.

Figure 9F:
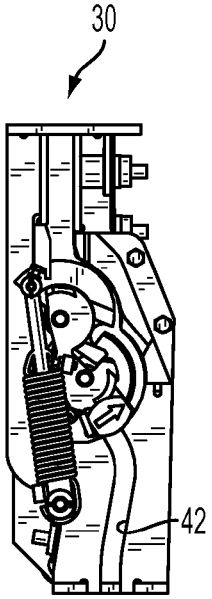
Figure 9G:
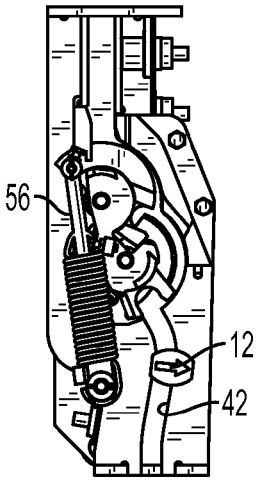
Figure 9H:
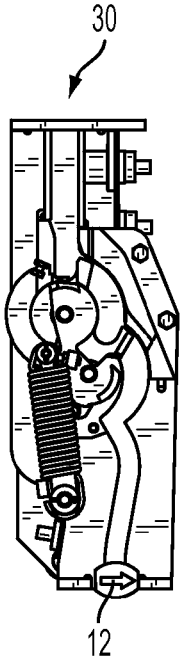

Referring to FIG. 9*f*, at the end of the travel of the second driver 58, the fastener 10 reaches the outlet 42 in the desired head right orientation, which it retains as the fastener exits the orienter as seen in FIGS. 9*g*-9*h*.

Figure 10A:
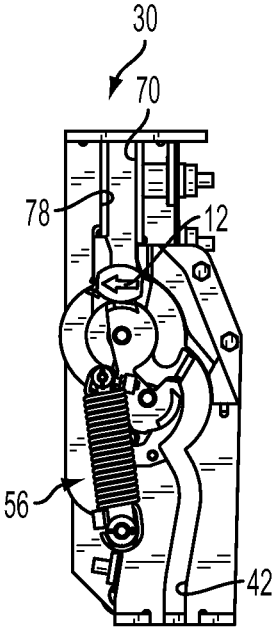
FIGS. 10*a-h* are sequential front elevational views of the present orienter positioning a head left fastener.
Figure 10B:
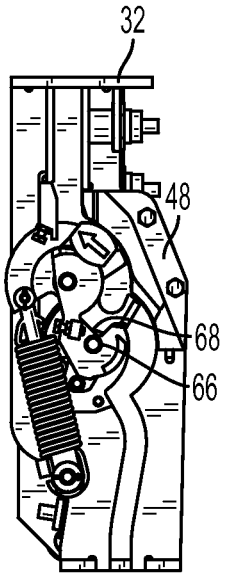
Figure 10C:
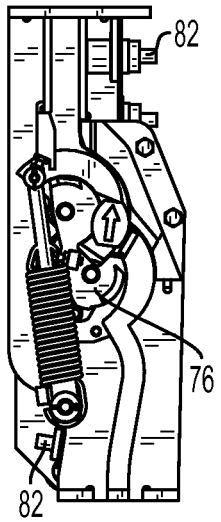

Referring now to FIGS. 10*a*-10*h*, operation of the present orienter 30 will be described when the fastener head 12 is in the head left oriented position. In FIG. 10*a*, the fastener 10 has entered the track 38, and is accommodated by the groove 64 in the first stage holder 44. Next, in FIG. 10*b*, as the first driver 56 extends, due to the left facing orientation of the tang 20, the outside bumper 48 is not engaged, and the fastener 10 retains its orientation through the extension of the first driver. In FIG. 10*c*, the fastener enters the transfer recess 68 in the head up orientation.

Figure 10D:
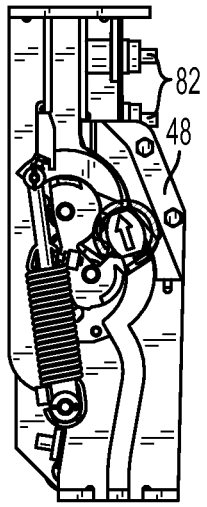

Referring now to FIG. 10*d*, as the second stage holder 46 engages the fastener 10, since the tang 20 faces the outside bumper 48, the engagement of the tang 20 upon the second ramped surface 74 causes the fastener 10 to rotate counter clockwise, so that the fastener is in the head up orientation. This is the only orientation in which the fastener 10 is manipulated by the ramped leading surface 72 of the outside bumper.

Figure 10E:
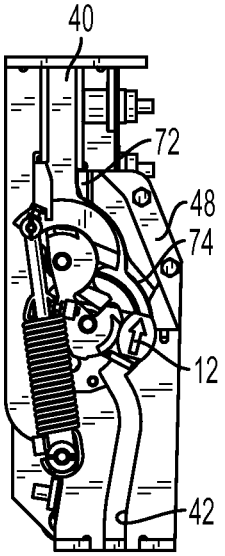
Figure 10F:
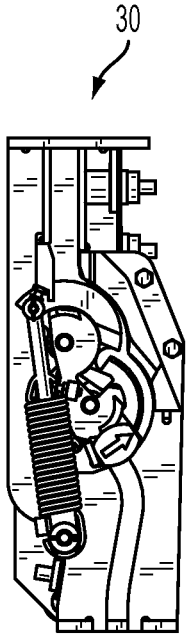
Figure 10G:
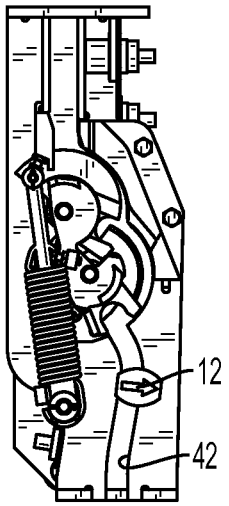
Figure 10H:
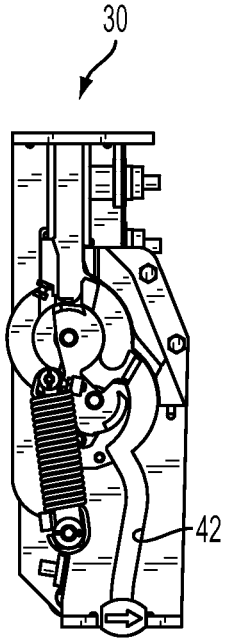

In FIG. 10*e*, the fastener 10 retains a head up orientation from the previous rotation described in FIG. 10*d* as the second driver 58 fully extends, and follows the track 38. In FIG. 10*f*, as the second driver 58 reaches the end of its extension, and the fastener 10 reaches the outlet 42, the fastener is in the desired head right orientation, which it retains as the fastener exits the orienter 30, as seen in FIGS. 10*g*-10*h*.

Figure 11A:
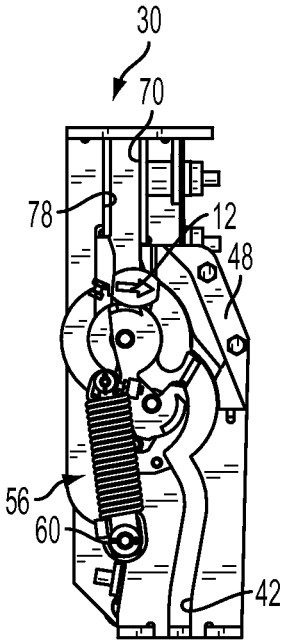
FIGS. 11 a-*h* are sequential front elevational views of the present orienter positioning a head right fastener.
Figure 11B:
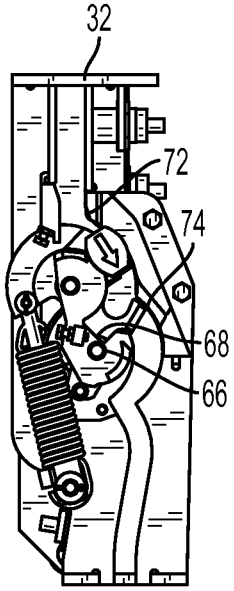
Figure 11C:
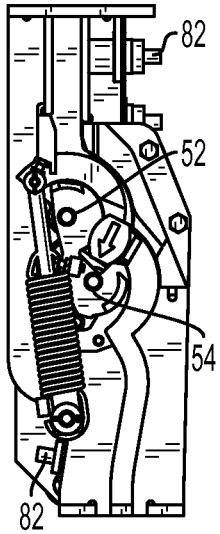

Referring now to FIGS. 11*a*-11*h*, the operation of the present orienter 30 will be described when the fastener head 12 is in the head right oriented position. In FIG. 11*a*, the fastener 10 is in the track 38, and is engaged in the groove 64 of the first stage holder 44 while in the head right orientation. In FIG. 11*b*, since the tang 20 is facing right, the outside bumper 48 is not engaged, and as the first driver 56 extends, the fastener 10 retains the head orientation until it is engaged in the transfer recess 68 in the inside bumper plate 51, as seen in FIG. 11*c*.

Figure 11D:
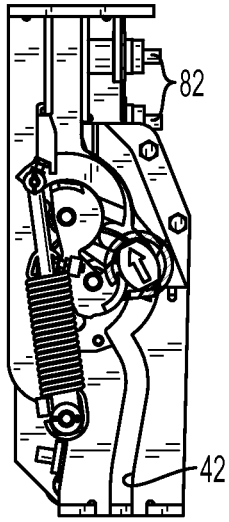
Figure 11E:
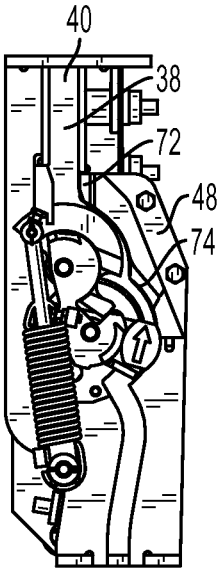
Figure 11F:
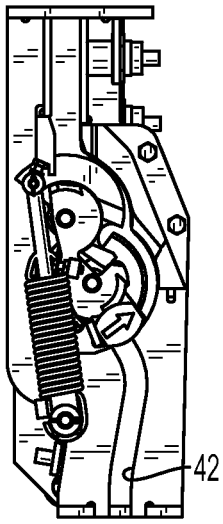
Figure 11G:
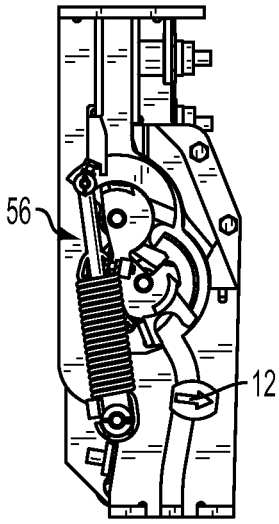
Figure 11H:
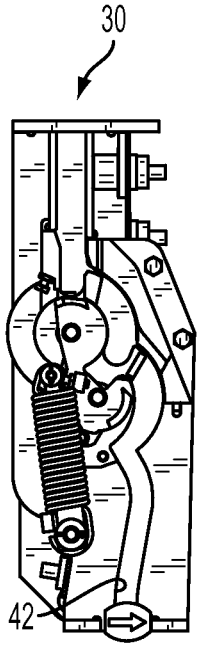

Referring now to FIG. 11*d*, the fastener 10 is engaged in the groove 64 in the second stage holder 46, and due to the inside facing position of the tang 20, the inside bumper 76 is engaged, causing the fastener to rotate clockwise to the head up position, which it retains as the second driver 58 extends, as seen in FIG. 11*e*. As seen in FIG. 11*f*, as the fastener 10 is deposited at the beginning of the outlet 42 by full extension of the second driver 58, the fastener retains the desired head right orientation, which it retains as the fastener exits the orienter 30, as seen in FIGS. 11*g*-11*h*.

Thus, it will be seen that the present orienter 30 is designed to accept a rail fastener 10 in any one of a head up, head down, head right and head left orientations, and without user input, automatically reorients the fastener to the desired head right orientation, which is useful for downstream transfer of the fasteners 10 to a fastener driving apparatus, as described in U.S. Pat. Nos. 5,398,616; 5,465,667 and 7,104,200, incorporated by reference.

While a particular embodiment of the present automatic rail fastener orienter has been shown and described, it will be appreciated by those skilled in the art that changes and modifications may be made thereto without departing from the invention in its broader aspects and as set forth in the following claims.

What is claimed:

1. A rail fastener orienter for orienting rail fasteners to a desired orientation, the fasteners having a head, an opposite tip and a shank connecting the head to the tip, and being sequentially provided to said orienter in one of a head right, head left, head up and head down orientation of the head, said orienter comprising:

a frame having an upper end and an opposite lower end, and defining a track with an inlet adjacent said upper end, and an outlet adjacent said lower end, said track dimensioned for slidingly and rotatingly accommodating the shank, the shank having a longitudinal axis that is transverse to a direction of travel of each spike through said passageway;

at least one stage holder for accommodating the fastener in said track as the head is at least partially engaged by at least one bumper for repositioning to a desired one of said orientations of the head, such that the fastener reaches said outlet in the desired orientation of the head after axial rotation of the shaft.

2. The rail fastener orienter of claim 1, wherein said at least one stage holder includes a first stage holder for moving the fastener along said track from a first position and a second position where the fastener is delivered to a handoff area, and a second stage holder for moving the fastener from a third position to a fourth position.

3. The rail fastener orienter of claim 2, further including a first driver for moving said first stage holder from said first position to said second position, and a second driver for moving said second stage holder from a third position to a fourth position.

4. The rail fastener orienter of claim 1 further including an outside bumper located on said frame in operational proximity to said track and being associated with a first stage holder, a handoff area in communication with said track and located between said first stage holder and a second stage holder, and an inside bumper located on said frame in operational proximity to said track and being associated with said second stage holder.

5. The rail fastener orienter of claim 2 further including a controller for operating said first stage holder sequentially before said second stage holder such that a fastener in said track is received by said first stage holder and encounters a first stage bumper for reorienting the head, and as said first stage holder is moved to said second position, the fastener is moved to a handoff area, whereafter said second stage holder receives the fastener, and said second stage holder is moved from said third position to said fourth position, and out said outlet.

6. A rail fastener orienter for orienting rail fasteners to a desired orientation, the fasteners having a head and an opposite tip and a shank connecting the head to the tip, said orienter comprising:

a frame having an upper end and an opposite lower end, and defining a track with an inlet adjacent said upper end, and an outlet adjacent said lower end, said track dimensioned for slidingly and rotatingly accommodating the shank;

a first stage holder configured for pivoting relative to said frame and defining a fastener retaining groove in communication with said track;

a first driver for moving said first stage holder from a first position to a second position;

a second stage holder configured for pivoting relative to said frame and defining a second fastener retaining groove in communication with said track;

a second driver for moving said second stage holder from a third position to a fourth position;

an outside bumper located on said frame in operational proximity to said track;

a handoff area in communication with said track and located between said first stage holder and said second stage holder;

an inside bumper located on an inside bumper plate defining said handoff device in operational proximity to said track;

a controller for operating said first stage sequentially before said second stage such that a fastener in said track is received by said first stage holder in said fastener retaining groove, and encounters said outside bumper for reorienting the head; as said first stage holder is moved to said second position, the fastener is moved to said handoff device, whereafter said second stage holder receives the fastener in said second groove, and said second stage holder is moved from said third position to said fourth position, and out said outlet.

7. The rail fastener orienter of claim 6 wherein said first driver is connected at one end to said frame, and at an opposite end to said first stage holder.

8. The rail fastener orienter of claim 6 wherein each of said first and second drivers is a fluid powered cylinder with a spring return.

9. The rail fastener orienter of claim 6 wherein said first driver is disposed on a first side of said frame and said second driver is disposed on an opposite side of said frame.

10. The rail fastener orienter of claim 6 wherein said outside bumper engages only fasteners where the head is positioned in a head up position in said track.

11. The rail fastener orienter of claim 6 wherein said inside bumper engages only fasteners where the head is positioned in a head down orientation when engaged in the handoff area.

12. The rail fastener orienter of claim 6 further including at least one sensor associated with said frame and in operational proximity to said track for sensing fasteners in said track and sending signals to said controller.

13. The rail fastener orienter of claim 6 wherein said second driver is connected at one end to said frame, and at an opposite end to said second stage holder.

14. The rail fastener orienter of claim 6 wherein said inside bumper is constructed and arranged for engaging and rotating a tang of the fastener as the fastener in a head down position is moved from said holding device to said outlet.

15. The rail fastener orienter of claim 6 wherein said outside bumper has a first portion engaging a tang of the fastener when the fastener is in the first stage holder, and a second portion constructed and arranged for engaging the tang when the fastener is in the second stage holder.

16. The rail fastener orienter of claim 6 wherein said second stage holder has a fastener head support configured for engaging the spike head.

17. A method for orienting rail fasteners having a shank with an offset head at one end, and a tip at an opposite end, comprising:

providing the fasteners to an orienter in an orientation with the head at one end;

feeding the fasteners sequentially to an orienter having a track dimensioned for slidingly and rotatably accommodating the fasteners, the fasteners having one of a head left, head right, head up and head down orientation;

passing the fasteners to a first stage holder moving between a first position and a second position, where the fastener head encounters an outside bumper when the head is in an undesirable position for rotating the shank so that the head is reoriented;

passing the fastener to a handoff area where the fastener is passed to a second stage holder moving from a third position to a fourth position;

providing at least one inside bumper surface for engaging and reorienting the head when in an undesirable position to a desirable position; and feeding the oriented fastener from an outlet of the track to a rail fastener applicator.

* * * * *